US007647746B2

(12) United States Patent
Ueda et al.

(10) Patent No.: US 7,647,746 B2
(45) Date of Patent: Jan. 19, 2010

(54) CAPPER HEAD

(75) Inventors: Nobuyuki Ueda, Yokohama (JP); Kenji Takeuchi, Yokohama (JP)

(73) Assignee: Toyo Seikan Kaisha, Ltd., Tokyo (JP)

( * ) Notice: Subject to any disclaimer, the term of this patent is extended or adjusted under 35 U.S.C. 154(b) by 484 days.

(21) Appl. No.: 11/569,840

(22) PCT Filed: Jun. 3, 2004

(86) PCT No.: PCT/JP2004/007696

§ 371 (c)(1),
(2), (4) Date: Nov. 30, 2006

(87) PCT Pub. No.: WO2005/118458

PCT Pub. Date: Dec. 15, 2005

(65) Prior Publication Data

US 2009/0193759 A1 Aug. 6, 2009

(51) Int. Cl.
*B67B 1/06* (2006.01)
*B67B 3/20* (2006.01)

(52) U.S. Cl. ..... 53/331.5; 53/317; 53/75; 53/485

(58) Field of Classification Search ..... 53/490, 53/331.5, 317, 75, 485, 484, 318, 334
See application file for complete search history.

(56) References Cited

U.S. PATENT DOCUMENTS 3,076,300 A * 2/1963 Luedi et al. ..... 53/331
4,075,820 A * 2/1978 Standley ..... 53/329.4
4,265,071 A * 5/1981 Smith et al. ..... 53/492
4,501,191 A * 2/1985 Webber et al. ..... 91/375 A
4,558,554 A * 12/1985 Herbert ..... 53/331.5
4,616,466 A * 10/1986 Tanaka et al. ..... 53/75

(Continued)

FOREIGN PATENT DOCUMENTS

EP 1236674 A1 9/2002

(Continued)

OTHER PUBLICATIONS

International Search Report of PCT/JP2004/007696, date of mailing Aug. 17, 2004.

(Continued)

*Primary Examiner*—Paul R Durand
(74) *Attorney, Agent, or Firm*—Westerman, Hattori, Daniels & Adrian, LLP

(57) ABSTRACT

A capper head for general purpose usable even when the specifications of a cap including thread pitches are changed without using a fixed gear and a lifting cam determining a lifting stroke and the timing thereof. The rotational output of a servo motor (2) is transmitted to a screw mechanism (4) through a sliding engagement section (3), and a screw shaft (17) is lowered while rotating for capping. The lowering stroke of the screw shaft (17) is allowed by the sliding engagement section (3). In capping, even if the strokes of a rotating chuck (7) and an output shaft (31) are different from the lowering stroke by the screw mechanism (4), a stroke difference absorption section (5) absorbs the stroke difference therebetween since a spring (23) in combination with a spline transmitting the rotation is deflected in the axial direction.

4 Claims, 4 Drawing Sheets

U.S. PATENT DOCUMENTS

| | | | | |
|---|---|---|---|---|
| 4,934,040 | A * | 6/1990 | Turchan | 29/566 |
| 5,197,258 | A * | 3/1993 | Johanek | 53/317 |
| 5,301,488 | A * | 4/1994 | Ruhl et al. | 53/55 |
| 5,321,935 | A * | 6/1994 | Spatz et al. | 53/490 |
| 5,584,161 | A * | 12/1996 | Zanini et al. | 53/317 |
| 5,687,552 | A * | 11/1997 | Barca | 53/490 |
| 5,983,596 | A * | 11/1999 | Corniani et al. | 53/317 |
| 6,410,909 | B1 * | 6/2002 | Rudolph et al. | 250/231.13 |
| 6,430,896 | B1 * | 8/2002 | Torikian | 53/310 |
| 6,519,913 | B2 * | 2/2003 | Higashizaki et al. | 53/75 |
| 6,857,250 | B1 * | 2/2005 | Taylor | 53/331 |
| 7,204,066 | B2 * | 4/2007 | Monti | 53/287 |
| 7,204,151 | B2 * | 4/2007 | Kitamoto et al. | 73/761 |
| 7,251,921 | B2 * | 8/2007 | Galimberti et al. | 53/317 |
| 7,299,602 | B2 * | 11/2007 | Denom et al. | 53/331 |
| 7,331,157 | B2 * | 2/2008 | Brown | 53/331.5 |
| 2002/0184853 | A1 * | 12/2002 | Arrant et al. | 53/343 |
| 2003/0154688 | A1 * | 8/2003 | Lang | 53/75 |

FOREIGN PATENT DOCUMENTS

| | | | |
|---|---|---|---|
| JP | 63-125191 | A | 5/1988 |
| JP | 9-76130 | A | 3/1997 |
| JP | 10-120086 | A | 5/1998 |
| JP | 10-324396 | A | 12/1998 |
| JP | 2000-505025 | A | 4/2000 |
| JP | 2003-95384 | A | 4/2003 |

OTHER PUBLICATIONS

European Office Action dated Nov. 15, 2007, issued in corresponding European Patent Application No. 1236674.

* cited by examiner

CAPPER HEAD

TECHNICAL FIELD

The present invention relates to a capper head for automatically screwing a cap clamped in a chuck onto a mouth section of a container, while rotating the cap.

BACKGROUND ART

A conventional capper head for screwing a cap onto a mouth section of a container is shown in FIG. 4. A capper head 40 shown in FIG. 4 comprises a fixed gear 41 that is fixed to a frame not shown in the figure, a planetary gear 42 that is engaged with the fixed gear 41 and revolves, while rotating, around the fixed gear 41, a sliding bearing 44 that is engaged with an output shaft 43 of the planetary gear 42 to transfer the rotation of the planetary gear 42 and is supported to as to be free to slide in the axial direction relative to a rotary frame not shown in the figure, a torque limiter 45 that is linked to the output side of the sliding bearing 44 and restricts the upper limit of a tightening torque, and a chuck 46 that is linked to the output side of the torque limiter 45 and rotates a cap (not shown in the figure). The planetary gear 42 is engaged with the fixed gear 41 so that the planetary gear can move in the axial direction, and the planetary gear together with the sliding bearing 44, torque limiter 45, and chuck 46 can move up and down with respect to the rotary frame. For example, a magnetic limiter in which the torque is easy to manage and which does not practically generate dust can be used as the torque limiter 45. A cam follower 47 engaged with a lifting cam 48 that is attached to the fixing gear 41 is provided at the sliding bearing 44 to lower the chuck 46 as the cap is tightened.

With the capper head 40 of such configuration, when the planetary gear 42 is revolved around the fixed gear 41 with a drive means not shown in the figure, the sliding bearing 44 revolves together with the planetary gear 42, whereby the planetary gear 42, sliding bearing 44, torque limiter 45, and chuck 46 are lifted or lowered by the cam action of the lifting cam 48 and the cam follower 47 engaged therewith and the cap held by the chuck 46 is brought close to or withdrawn from the mouth section of a container. If screwing of the cap on the mouth section of the container is started, the planetary gear 42 rotates, while revolving together with the sliding bearing 44, torque limiter 45, and chuck 46, due to the engagement with the fixed gear 41, and the chuck 46 rotates the cap at a rate of this rotation of the planetary gear and screws the cap on the mouth section of the container. The rotation rate of the planetary gear 42 in this process is a constant rotation rate determined by the gear ratio of the planetary gear and fixed gear 41. The cap moves down around the mouth section correspondingly to the degree of tightening of the mouth section of the container and the pitch of the screwing thread, but a buffer section is provided in the upper part of the chuck 46 and absorbs the stroke difference caused by the rotation in excess of the number of turns necessary for tightening (about 3 turns). Because the chuck 46 descends correspondingly to the sinking degree of the cap when the cap is tightened, the capping operation is implemented without damaging the thread or incorrect tightening.

Another example of the conventional capper head is shown in FIG. 5. In a capper head 50 shown in FIG. 5, the elements common with the capper head 40 shown in FIG. 4 are assigned with the same symbols and the explanation thereof is omitted. The difference between the capper head 50 and the capper head 40 is in that a servo motor 51 is used instead of the planetary gear 42 and torque limiter 45. The rotation of the servo motor 51 is transmitted to the chuck 46 via a drive shaft 52 of the motor and the slide bearing 44 and a cap is tightened on the mouth section of the container. The servo motor 51, sliding bearing 44, and chuck 46 revolve integrally around a cam shaft axis 49 of the lifting cam 48 by a drive means not shown in the figure. Corresponding to this revolving action, all the components from the servo motor 51 to the chuck 46 via the sliding bearing 44 are brought close to or withdrawn from the mouth section of the container correspondingly to the tightening of the cap by the cam action of the cam follower 47 and lifting cam 48 provided at the external members of the sliding bearing 44.

In the capper head 40 shown in FIG. 4, the rotation rate of the planetary gear 42 is also the rotation rate of the chuck 46. Therefore, the rotation rate when the cap is tightened is also constant with respect to the revolution rate. Furthermore, the lifting stroke of the chuck 46 and the timing thereof depend on the cam shape of the lifting cam 48. Because the lowering degree of the chuck 46 is determined by the specifications of the container or cap, the cam shape of the lifting cam 48 has to be determined in advance. On the other hand, in the capper head 50 shown in FIG. 5, since the chuck 46 is rotated by the servo motor 51, the rotation rate of the chuck 46 can be randomly changed by the servo motor 51. Furthermore, the tightening torque can be randomly changed by the servo motor 51 in the course of operation.

In the above-described conventional capper heads, a lifting cam is used for lifting and lowering the chuck, but because the cam and cam follower are formed by processing wear-resistant materials, the processing cost is high and the production cost of the capper head or screwing apparatus is unavoidably increased. Furthermore, because the contact portions of the fixed gear and planetary gear and also the cam and cam follower are exposed, there is still space for improvement in terms of noise and dust generation. For the cam follower to slide inside a cam groove of the lifting cam, a grease is used as a lubricant in the contact zone, but even if a grease with a high viscosity is used, the spattering of grease during operation of the apparatus is difficult to prevent completely and the surrounding environment that has to be maintained in a clean state to handle the filled containers can be contaminated. Furthermore, when the specification including the thread pitch of the cap are changed, the lifting stroke and the timing thereof have to be changed, but the fixed gear or lifting cam have to be replaced to adapt to such a change.

A capper has been suggested in which container clamping mechanisms are provided in positions equidistantly spaced in the circumferential direction on a rotary table constituting a rotary body that is rotary driven by a motor, torque motors and cap clamping mechanisms that are rotary driven by the torque motors are attached in positioned immediately above each container clamping mechanism so that the torque motors and the cap clamping mechanisms can be lifted and lowered by a guide pole, the torque motors and cap clamping mechanisms are lifted and lowered integrally by the cam action with a cam mechanism fixed on the outside, and the drive shaft of the torque motor and the rotary shaft that rotates the cap clamping mechanism are key-joined, thereby enabling the transmission of torque motor rotation, while allowing the rotary shaft to be lifted or lowered. It was also suggested to control the drive torque produced by the torque motor according to the rotation position of the rotary body.

Patent Document 1: Japanese Patent Application Laid-open No. H10-324396 (Par. No. [0002]-[0003], [0007]; FIG. 1)

SUMMARY OF THE INVENTION

Accordingly, the problem to be resolved is to obtain a simple structure for lowering a chuck, while rotating it, in a capper head for screwing a cap on the mouth section of a container by improving the internal structure, without relying on gears or a cam and a cam follower that are exposed to the outside and are expensive to produce, such as a fixed gear and lifting cam.

It is an object of the present invention to provide a capper head that does not use a fixed gear and a lifting cam to set the lifting stroke and timing thereof, as in the conventional capper heads, has a simple structure, and does not contaminate the environment.

To attain the above-described object, the present invention provides a capper head comprising a servo motor that outputs rotation to a motor output shaft, a screw mechanism that is rotated by the motor output shaft and has a screw output shaft that is displaced axially by a screw action based on the rotation, and a chuck that is linked to the screw output shaft and can hold a cap that is tightened on a mouth section of a container.

With such capper head, when the servo motor is actuated, the rotation thereof is outputted to the motor output shaft. The rotation of the motor output shaft is transmitted to the screw mechanism. In the screw mechanism, the screw output shaft is rotated by the rotation of the motor output shaft and the screw action converts the rotation into the axial displacement. Because the chuck is linked to the screw output shaft, the chuck rotates, while holding the cap, whereby the cap is tightened on the mouth section of the container. Furthermore, the axial displacement of the screw output shaft can ensure the tightening action of the chuck, that is, sinking, while tightening the cap.

In such capper head, the screw mechanism comprises a fixed nut that is thread-engaged with the screw output shaft and provides the screw action, and a sliding engagement section that engages the screw output shaft with the motor output shaft so that the rotation can be transferred, while allowing the axial displacement. With such configuration of the screw mechanism, when the screw output shaft rotates by receiving the rotation of the motor output shaft, the screw output shaft is displaced in the axial direction by the screwing action of the fixed nut thread-engaged therewith. Even when the screw output shaft is displaced in the axial direction, the engagement thereof with the motor output shaft is maintained by the sliding engagement section. Therefore, the rotation of the motor output shaft is transmitted, without any obstacle, to the screw output shaft. For this reason, the screw output shaft can continue transmitting rotation, while being capable of sliding in the axial direction with respect to the motor output shaft.

In such capper head, the screw output shaft can comprise a unidirectional clutch section that transmits rotation from the servo motor in a direction of tightening the cap, but does not transmit the rotation in an unwinding direction. A cap tightened on the mouth section of a container has to be prevented from being unwound by the return action of the capper head. With the capper head of such configuration, when the rotation direction of the rotation output of the servo motor is the cap tightening direction, the unidirectional clutch section provided at the screw output shaft transmits the rotation and tightens the cap, but when the rotation direction of the rotation output of the servo motor is the cap unwinding direction, the unidirectional clutch section does not transmit the rotation. Therefore, because the chuck rises, without rotation, together with the screw output shaft, the cap tightened on the mouth section of the container is not unwound by the return action of the capper head.

In such capper head, the screw output shaft can comprise a stroke difference absorption section that absorbs a stroke difference between the screw output shaft and the chuck based on a difference between the pitches. Specifications of caps, including the thread pitch, sometimes vary according to the container. It is preferred that in such cases, too, the lifting stroke and timing thereof could be left unchanged in the capper head. For this purpose, it is usually preferred that the thread pitch of the screw output shaft be generally set larger than the thread pitch for tightening the cap and that the stroke difference on a transmission path based on the difference between the two pitches during rotation of the screw output shaft and the chuck be absorbed by a stroke difference absorption section. Furthermore, as the tightening of the cap is started, when the end section of a female thread section of the cap starts engaging with the end section of a male thread section of the mouth section of the container, the cap is sometimes displaced in the axial direction by one pitch maximum by passing above or below the thread peak of the male thread section, but in this case, too, the stroke difference absorption section can absorb such axial displacement. Thus, a capper head of high utility can be obtained that can be employed even when the specifications of the cap, including the thread pitch, are changed or when a displacement occurs as the female threaded section of the cap starts engaging with the male threaded section of the mouth section of the container. For example, a section that absorbs the stroke difference by elastic deformation of a spring is preferred as the stroke difference absorption section.

The capper head can comprise a fixed case that accommodates the screw mechanism, a seal member that seals an outlet port of the case which the screw output shaft passes through and extends, and an obstruction member that is provided in a portion of the screw output shaft that extends to outside of the case and abuts against the seal member when the screw output shaft is lifted to prevent permeation of liquid into said case when the chuck is washed. Because the chuck that clamps the cap is exposed to the outside of the fixed case accommodating the screw mechanism, contamination can adhere thereto, and it is desired that the chuck be cleaned periodically with a sterilization liquid or the like. Even when the outlet port of the case which the screw output shaft passes through and extends is sealed with the seal member, the sprayed sterilization liquid can permeate into the inside of the case through the seal under the pressure. Accordingly, it is preferred that the obstruction member be provided in the portion of the screw output shaft that extends to the outside of the case and return rotation is performed more than the regulated rotation of the servo motor, whereby the obstruction member be abutted against the seal member by the lift of the screw output shaft. Because a state is assumed in which the obstruction member is pressed against and covers the outside of the seal member, the permeation of the sprayed sterilization liquid into the case through the seal member can be prevented.

This capper head can be synchronously revolved, while maintaining the position immediately above the each of containers, around a turret that clamps a plurality of the containers in positions spaced in a circumferential direction and revolves the containers. The capper head can independently act upon individual containers that are conveyed directly therebelow, but a plurality of capper heads may successively tighten caps on a multiplicity of containers that are arranged and conveyed in a row. The above-described capper head can be directly employed with the turret, without changing the conventional arrangement in which the capper head is revolved synchronously with the turret, while maintaining the position immediately above the containers, in the turret that clamps a plurality of the containers in positions spaced in a circumferential direction and revolves the containers.

As described hereinabove, the capper head in accordance with the present invention comprises the sliding engagement section and screw mechanism between the servo motor and chuck. Therefore, the chuck descends correspondingly to the thread pitch of the cap, while rotating under the drive force of the servo motor, in the same manner as in the conventional structure. Because the capper head does not use a fixed gear and lifting cam that determine the lifting stroke and timing thereof in order to obtain such an actuation of the chuck, the capper head has a simple structure that can be realized at a low cost. Furthermore, when the stroke difference absorption section is provided at the screw output shaft, even when the thread pitch of the cap changes according to specifications or when an axial displacement occurs due to the mode of engagement of the thread peaks, the male threaded section and female threaded section as the tightening is started, the difference between the stroke provided by the screw mechanism and the stroke occurring in the chuck is automatically absorbed by the stroke difference absorption section. The servo motor may be driven by taking into account only the speed and torque of tightening. Thus, a capper head of high utility can be provided in which, even when the specifications of the cap, including the thread pitch, are changed, the replacement of the fixed gear and lifting cam that set the lifting stroke and timing thereof, which was necessary in the conventional capper heads, is unnecessary. Furthermore, when the screw output shaft is provided with a unidirectional clutch section, even when the outer peripheral surface of the cap is a taper-free cylindrical surface and the engagement with the chuck is not immediately released when the chuck starts to move up, the unwinding of the tightened cap can be prevented.

DETAILED DESCRIPTION OF THE INVENTION

Figure 1:
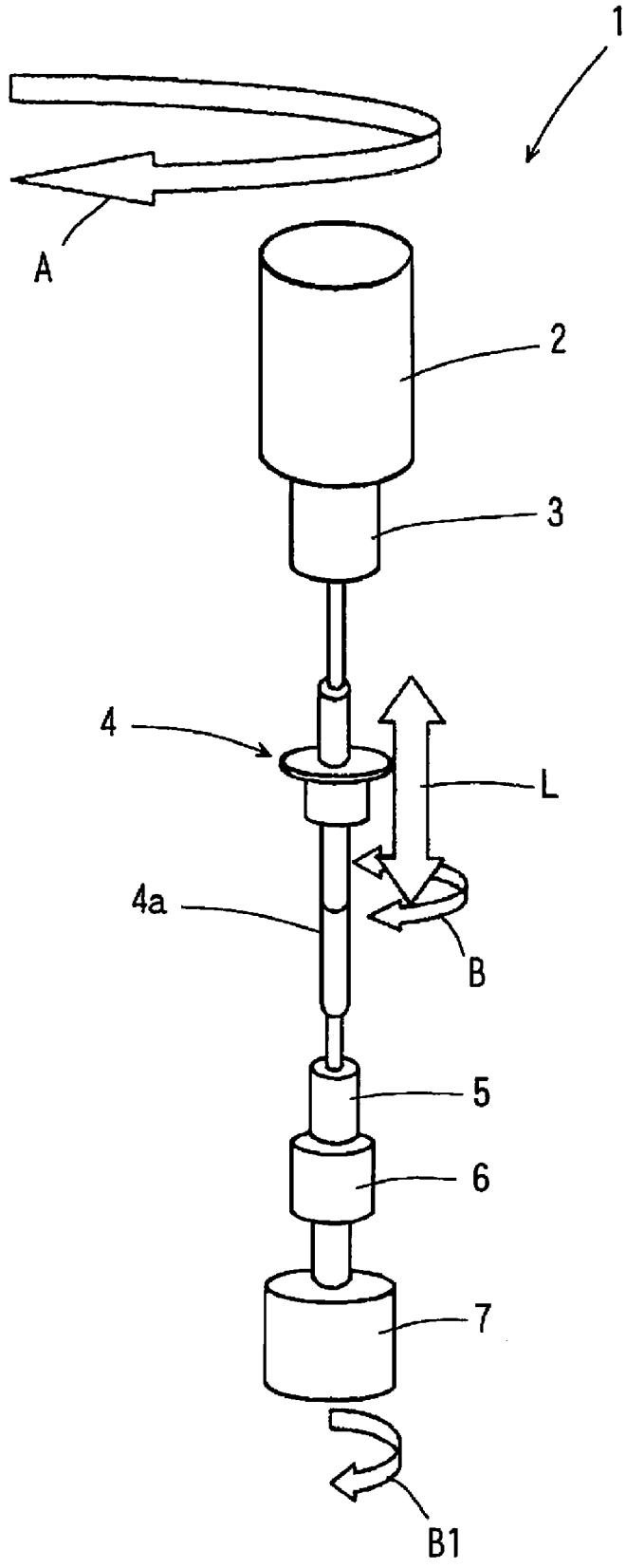
FIG. 1 is a schematic perspective view illustrating an embodiment of the capper head in accordance with the present invention.
Figure 2:
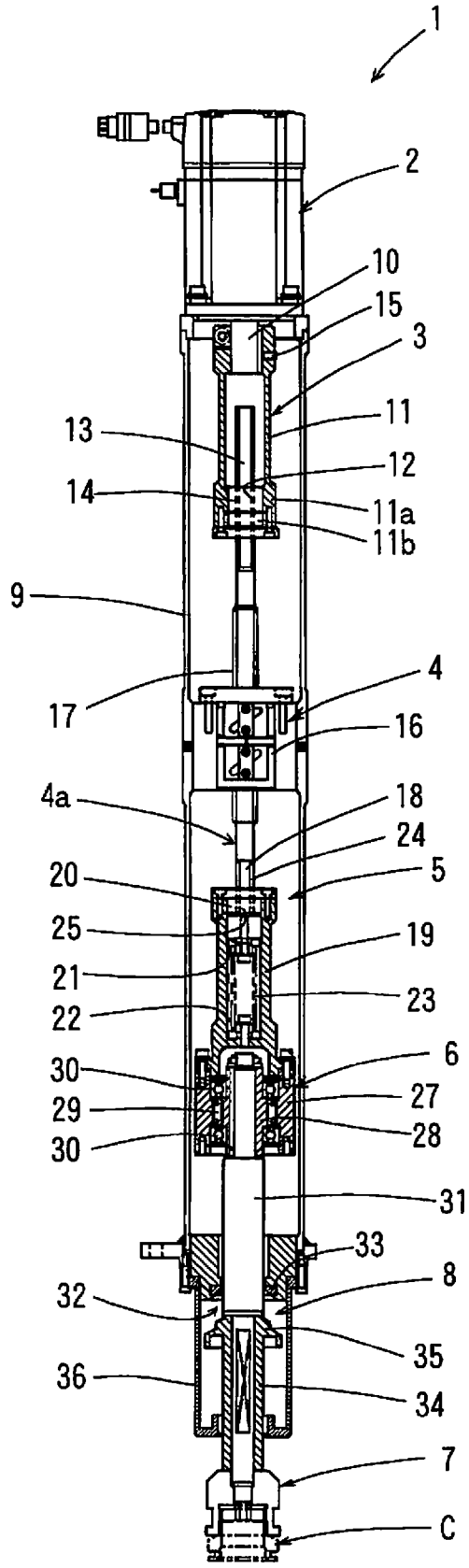
FIG. 2 is a vertical cross-sectional view of the capper head shown in FIG. 1.

An embodiment of the capper head in accordance with the present invention will be described below based on the appended drawings. FIG. 1 is a schematic perspective view illustrating an embodiment of the capper head in accordance with the present invention. FIG. 2 is a vertical cross-sectional view of the capper head shown in FIG. 1.

As shown in FIG. 1, a capper head 1 comprises, from the top thereof, a servo motor 2 that is revolved and rotated, a sliding engagement section 3 that transmits the rotation of a motor output shaft of the servo motor 2, but allows the engagement portion to move in the axial direction and can be extended as a whole, a screw mechanism 4 linked to the output side of the sliding engagement section 3, and a chuck 7 linked to a screw output shaft 4*a* of the screw mechanism 4. The screw output shaft 4*a* is provided with a stroke difference absorption section 5 and a unidirectional clutch section 6 linked to the output side of the stroke difference absorption section 5. The chuck 7 is linked to the output side of the unidirectional clutch section 6. As shown in FIG. 2, a fixed case 9 having a cylindrical shape and mounted on the servo motor 2 accommodates the sliding engagement section 3, screw mechanism 4, stroke difference absorption section 5, and unidirectional clutch section 6. The case 9 covers the components of the capper head 1 from the sliding engagement section 3 to a section immediately above the chuck 7 and serves to prevent foreign matter such as dust generated by mechanical engagement from scattering to the outside and to maintain a clean surrounding environment.

The servo motor 2 is a motor with easy torque management and is used for rotating the chuck 7. The servo motor 2 is revolved and rotated (see arrow A in FIG. 1) about a rotation axis of a turret that rotates, while clamping a container, by a rotary mechanism not shown in the figures. The servo motor 2 can rotate in both directions (see arrow B in FIG. 1). For example, when the motor is rotated to the right, a cap can be tightened on the mouth section of a container by rotating and lowering the chuck 7 (see arrow B1 in FIG. 1), and when the motor is rotated to the left, the chuck 7 can be lifted up, without transmitting the torque to the chuck 7, by the action of the below-described unidirectional clutch section 6 (the movement in the vertical direction is shown by arrow L in FIG. 1).

As shown in FIG. 2, the sliding engagement section 3 comprises a tubular shaft 11 serving as an input member that is integrally joined to a motor output shaft 10 of the servo motor 2 and has inner spline teeth 12 formed on the inner side of the lower portion thereof and a spline shaft 13 serving as an output member that extends by part thereof into the inside of the tubular shaft 11 and has formed thereon outer spline teeth 14 for engagement with the inner spline teeth 12. The tubular shaft 11 is fixed to the motor output shaft 10 with a key 15 and rotates integrally with the motor output shaft 10. An inner teeth portion 11*b* where the inner spline teeth 12 have been formed can be fixed with a screw to a main body portion 11*a* of the tubular shaft 11 as shown in the figure. In the spline shaft 13, the outer spline teeth 14 are engaged with the inner spline teeth 12, thereby enabling the transmission of the output rotation of the servo motor 2 at all times, but the axial movement is allowed during the actuation of the below-described screw mechanism 4.

The screw mechanism 4 linked to the output side of the sliding engagement section 3 comprises a nut 16 fixed to the case 9 and a screw shaft 17 constituting part of the screw output shaft 4*a* and engaged with the nut 16. The screw shaft 17 can have a structure integrated with the spline shaft 13 extending from the sliding engagement section 3, whereby the number of components is reduced. The screw mechanism 4 can be a ball screw mechanism in which the nut 16 is a ball nut that incorporates rotary bodies that rotate, while being in contact with a screw groove of the screw shaft 17, so that the rotary bodies can circulate therein, and in which an axial movement is provided to the screw shaft 17 by a smooth screw conversion operation performed via balls, in addition to a rotary movement when the screw shaft 17 performs the rotary movement. The axial movement of the screw shaft 17 in this process is allowed by the sliding engagement section 3.

The screw shaft 17 further extends downward and reaches the stroke difference absorption section 5. The stroke difference absorption section 5 comprises a shaft end section 18 serving as an input spline member extending at the lower side of the screw shaft 17 and having outer spline teeth 24 formed therein, a tubular shaft section 19 surrounding the shaft end section 18, an adapter 20 that is fixed to the tubular shaft section 19 and has formed therein inner spline teeth 25 that engage with the outer spline teeth 24 of the shaft end section 18, and a spring 23 provided in a compressed state between a spring receptacle 21 mounted on the shaft end section 18 inside the adapter 20 and a bottom surface 22 of the tubular shaft section 20. Therefore, the rotation of the screw shaft 17 is directly transmitted to the tubular shaft section 19 by the spline mating of the outer spline teeth 24 and inner spline teeth 25. The stroke difference absorption section 5 has a function of absorbing the difference between a stroke generated in the screw shaft 17 by screw actuation of the screw mechanism 4 per one turn of the screw shaft 17, that is, the motor output shaft 10 of the servo motor 2, when a cap C is tightened and a stroke of the cap C generated by screwing together the cap C and the mouth section of the container when the chuck 7 tightens the cap C. The two strokes are usually descending strokes, and the stroke generated in the screw shaft 17 is set to a value larger than that of the stroke of the cap C. The difference between the two strokes is absorbed by deflection of the spring 23 caused by elastic deformation in the axial direction. When the tightening of the cap C is completed and the load acting upon the capper head 1 is released, the stroke difference absorption section 5 returns to the state prior to the appearance of the stroke difference by a recovery force of the spring 23.

The following two phenomena can occur when the tightening of the cap C is started. Thus, when the end portion of the female thread section formed in the cap C starts the engagement with the end portion of the male thread section formed in the mouth section of the container, in the extreme case, the effective tightening is started immediately via the zone below the thread peaks of the male thread or the tightening is ineffective within one turn via the zone above the thread peaks. The displacement in the axial direction can be of the size of one pitch at maximum by the first turn, according to the form of engagement or passage of the male thread section and female tread section. In this case, the stroke difference absorption section 5 can absorb this axial displacement.

Figure 3:
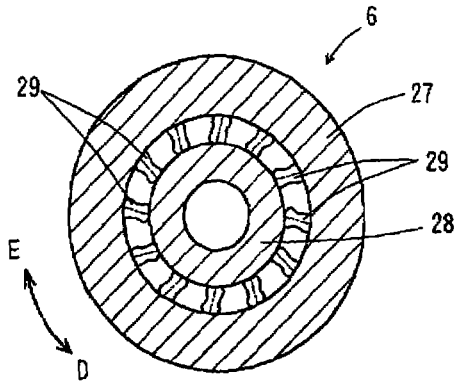
FIG. 3 is a cross-sectional view of a unidirectional clutch section used in the capper head shown in FIG. 2.
Figure 4:
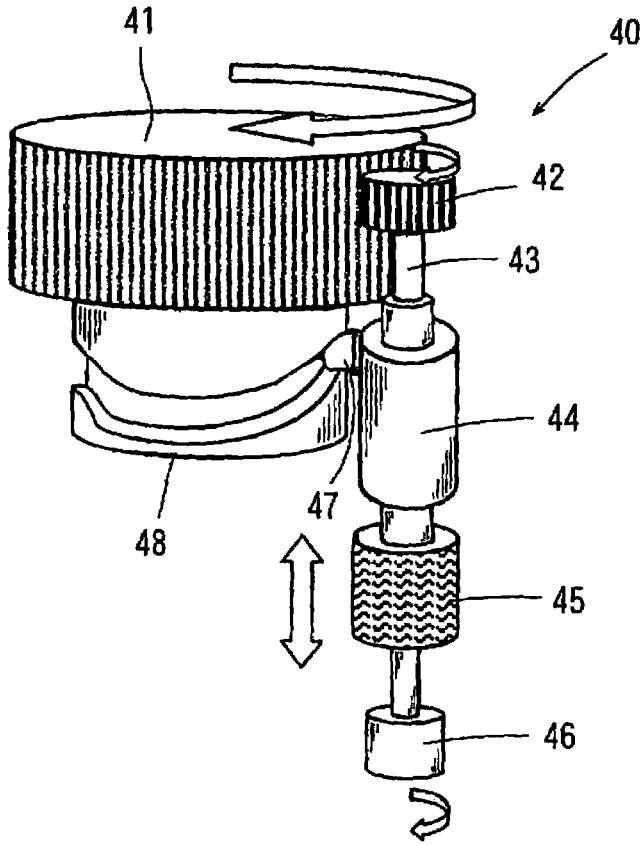
FIG. 4 is a perspective view illustrating an example of the conventional capper head using a fixed gear and a planetary gear.
Figure 5:
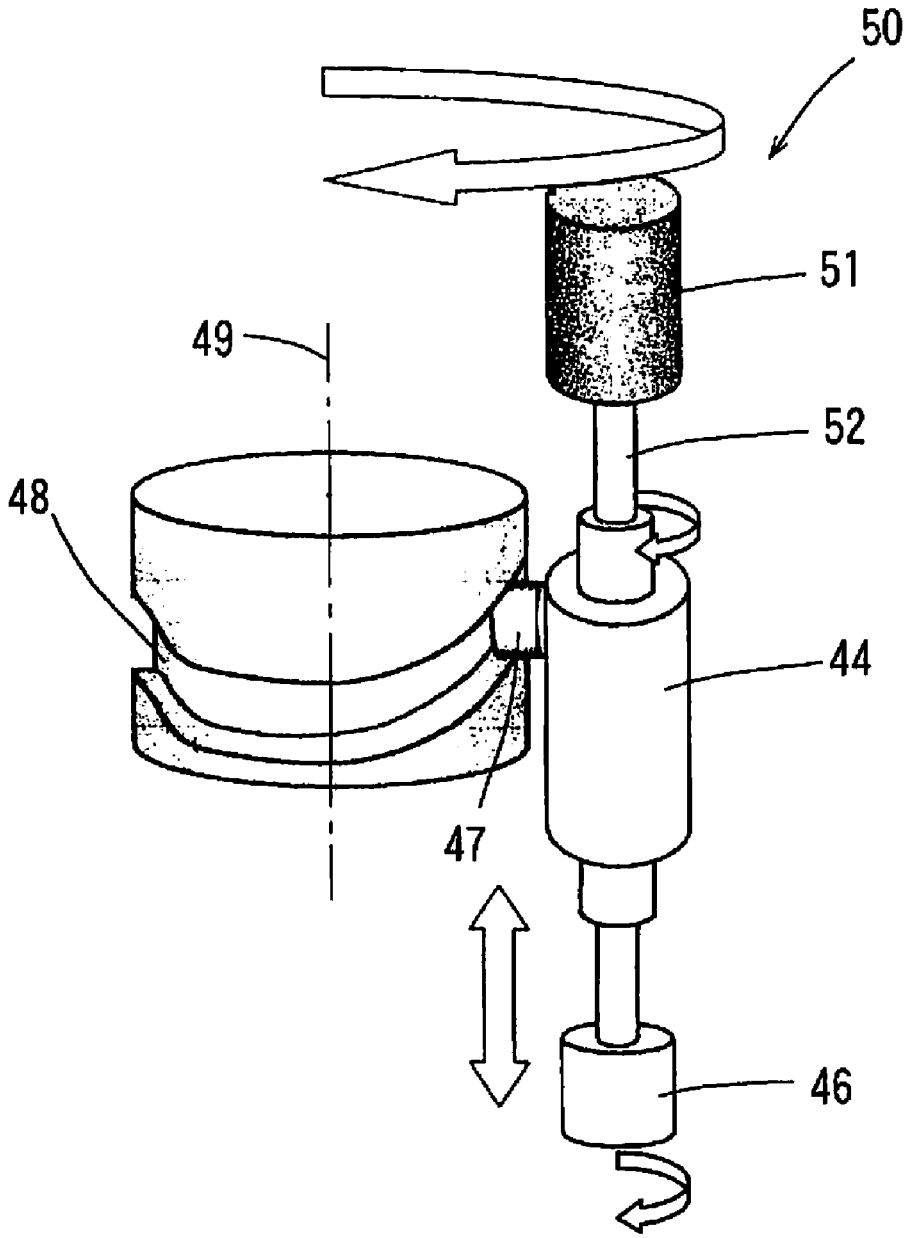
FIG. 5 is a perspective view illustrating another example of the conventional capper head using a servo motor.

The unidirectional clutch section 6 that follows the stroke difference absorption section 5 comprises a cup-shaped outer member 27 mounted on the tubular shaft section 20, an inner member 28 accommodated inside the outer member 27 and joined integrally with an output shaft (constituting part of the screw output shaft 4*a*) 31 of the capper head 1, and a clutch member 29 inserted between the outer member 27 and inner member 28 and transmitting the rotation of the outer member 27. The cross section of the unidirectional clutch section 6 is shown in FIG. 3. When the outer member 27 rotates in one direction (shown by arrow D), that is, in the direction of screwing the cap, the clutch member 29 engages with the outer member 27 and inner member 28 and transmits this rotation. During rotation in the opposite direction (shown by arrow E), the clutch member is inclined, disengaged from the outer member 27 and inner member 28, and rotates freely without transmitting the torque. Because the output shaft 31 is not rotated during the reverse rotation, the tightened cap C is prevented from being un-tightened. The inner member 28 is prevented by a bearing 30 from pulling out from the outer member 27.

The clutch 7 that clamps the output shaft 31 or cap C is exposed to the outside of the case 9 that accommodates the sliding engagement section 3, screw mechanism 4, and stroke difference absorption section 5. Therefore, contaminants can adhere to the clutch, and it is preferred that the clutch be periodically cleaned with a sterilization liquid or the like. A seal section 8 is provided between the unidirectional clutch section 6 and the case 9 below the clutch section. The seal section 8 is provided in an outlet port 32 of the case 9 having the output shaft 31 extending therethrough and comprises a seal member 33 such as an O-ring for sealing between the output shaft 31 and the outlet port 32 of the case 9. When the seal member 33 alone is used, there is a risk of the sterilization liquid permeating into the case 9 from the outlet port 32 of the case 9 under the effect of the spraying pressure of the reagent. Accordingly, the seal section 8 comprising an obstruction member 34 that abuts against the seal member 33 when the output shaft 31 is lifted is provided in the portion of the output shaft 31 that extends to the outside of the case 9. A distal end portion of the obstruction member 34 that faces the seal member 33 is a conical head section 35. The conical head section 35 is formed as a protrusion complementary to the conical recess shape of the seal member 33. By rotating the servo motor 2 back in excess of the usual rotation, for example, during periodic cleaning, the obstruction member 34 is raised together with the output shaft 31 till the conical head section 35 abuts against the seal member 33. The outer side of the seal member 33 is covered with the obstruction member 34, and the seal member 33 is strongly pressed against the output shaft 31 and outlet port 32. Therefore, the sprayed sterilization liquid has no chance of coming into contact with the seal member 33 and is completely prevented from permeating inside the case 9 via the circumference of the seal member 33. When the output shaft 31 and chuck 7 are cleaned, a cover 36 mounted on the distal end of the case 9 is removed.

The operation sequence of the capper head 1 will be explained below. The capper head 1 is revolved and rotated by a rotary mechanism not shown in the figure. In the course of the revolution and rotation, the servo motor 2 is driven to rotate the chuck 7. The rotation (for example, rightward rotation) of the motor output shaft 10 is transmitted from the tubular shaft 11 in the sliding engagement section 3 to the spline shaft 13 via the spline mating of the tubular shaft 11 and spline shaft 13 and inputted in the screw shaft 17 integrated with the spline shaft 13 in the screw mechanism 4. Because the nut 16 of the screw mechanism 4 is fixed to the case 9, when the screw shaft 17 rotates, the screw shaft 17 is moved in the axial direction by the descending stroke. Such movement of the screw shaft 17 is allowed and absorbed by the axial displacement of the spline shaft 13 with respect to the tubular shaft 11 in the sliding engagement section 3. The rotation accompanied by the axial displacement of the screw shaft 17 is transmitted to the unidirectional clutch section 6 via the tubular shaft section 19 by the spline mating of the shaft end section 18 and adapter 20 in the stroke difference absorption section 5. In the unidirectional clutch section 6, the rightward rotation of the outer member 27 is transmitted to the inner member 28 because the clutch member 29 assumes an engaged state, then transmitted to the output shaft 31 of the capper head 1 and the chuck 7 linked to the output shaft 31, causes the rotation of the cap C held by the chuck 7, while displacing the cap in the axial direction, and tightens the cap C on the mouth section of the container.

As the cap C is tightened on the mouth section of the container, the cap C, chuck 7, and output shaft 31 displace axially in the direction of descending according to the thread pitch of the cap. In the stroke difference absorption section 5, the axial displacement quantity of the screw shaft 17 is determined by the thread pitch of the screw mechanism 4 and the axial displacement quantity of the adapter 20 on the output side is determined by the thread pitch of the cap C. Therefore, the two axial displacement quantities are generally different. For example, when the thread lead is 10 mm in the screw shaft 17 of the screw mechanism 4, the thread lead of the cap C and the mouth section of the container is, for example, 3 mm (or 6 mm or 9 mm) and generally they do not match. The screw shaft 17 descends with a 10 mm stroke per one turn of the servo motor 2, but the chuck 7 descends with a 3 mm stroke. If this stroke difference is left as is, the threads of the cap C and the mouth section of the container can be fractured, but with the capper head 1, in the stroke difference absorption section 5 the shaft end section 18 descends with a 10 mm stroke, whereas the tubular shaft section 19 descends with a 3 mm stroke, and the 7 mm stroke difference is absorbed by the deflection of the spring 23 induced by elastic deformation. As this stroke difference is tolerated, the shaft end section 18 and adapter 20 are spline-mated due to the engagement of the outer spline teeth 24 and inner spline teeth 25 and the rotation force is transmitted. Therefore, the cap C can be tightened on the mouth section of the container, without breaking the thread.

If the servo motor 2 rotates in reverse (leftward rotation) after the tightening of the cap C has been completed, the screw shaft 17 of the screw mechanism 4 rises, while rotating, via the sliding engagement section 3, and the stroke difference absorption section 5 also rises, while rotating. In the unidirectional clutch section 6, the outer member 27 rotates, but the clutch member 29 assumes a non-engaged state and the inner member 28 does not rotate. Therefore, the chuck 7 only rises without rotation. If the outer peripheral surface of the cap C is a tapered conical surface, the engagement of the chuck 7 and cap C is sometimes released when the chuck 7 rises. However, if the outer peripheral surface of the cap C is a taper-free cylindrical surface, the engagement with the cap C is not immediately released even if the chuck 7 rises. In this case, the unidirectional clutch section 6 rises without rotating the output shaft 31. Therefore, because the rotation of the chuck 7 is not reversed, the tightened cap C is not unwound.

By using the servo motor 2 as a drive source, the speed and torque control is facilitated. Therefore, the chuck 7 can be actuated at any rate and, any timing, and any stroke.

INDUSTRIAL APPLICABILITY

In accordance with the present invention, a sliding engagement section and screw mechanism are provided between a servo motor and a chuck in each head, the chuck can be rotated and raised or lowered without a cam mechanism or fixed gear, and the lifting stroke can be easily changed with a simple mechanism. Therefore, the present invention has high practical utility and can be applied to cappers that tighten caps on mouth sections of containers of various types.

The invention claimed is:

1. A capper head, comprising:

a servo motor, a motor output shaft, said motor output shaft being rotated by said servo motor, a screw mechanism including a screw output shaft, said screw output shaft being rotated by said motor output shaft and being axially displaced by screw action based on rotation of said screw output shaft, a chuck linked to said screw output shaft, said chuck being capable of holding a cap that is tightened on a mouth section of a container, and a sliding engagement section that engages said screw output shaft with said motor output shaft so that the rotation can be transferred from said motor output shaft to said screw output shaft while allowing said axial displacement of said screw output shaft, wherein said screw mechanism further comprises a fixed nut that is thread-engaged with said screw output shaft and provides the screw action, and wherein said screw output shaft comprises a stroke difference absorption section that absorbs a stroke difference between said screw output shaft and said chuck based on a difference between pitches of said screw output shaft and said chuck.

2. The capper head according to claim 1, wherein said screw output shaft comprises a unidirectional clutch section that transmits rotation from said servo motor in a direction of tightening said cap, but does not transmit the rotation in an unwinding direction.

3. The capper head according to claim 1, further comprising:

a fixed case that accommodates said screw mechanism, a seal member that seals an outlet port of said case which said screw output shaft passes through and extends, and an obstruction member that is provided in a portion of said screw output shaft that extends to outside of said case and abuts against said seal member when said screw output shaft is lifted, to prevent permeation of liquid into said case when said chuck is washed.

4. The capper head according to claim 1, wherein said capper head is synchronously revolved around a turret that clamps a plurality of said containers in positions spaced in a circumferential direction and revolves the containers, while maintaining a position immediately above each of containers.

* * * * *